US012310512B2

(12) United States Patent
Bunting et al.

(10) Patent No.: US 12,310,512 B2
(45) Date of Patent: May 27, 2025

(54) APPARATUS AND METHOD OF VERTICALLY ADJUSTING REINFORCING SUPPORT STRUCTURE

(71) Applicant: REBAR SUPPORT PRODUCTS, INC., Louisville, KY (US)

(72) Inventors: Leif Bunting, Prospect, KY (US); Roger Hardy Holland, West Chester, OH (US)

(73) Assignee: REBAR SUPPORT PRODUCTS, INC., Louisville, KY (US)

( * ) Notice: Subject to any disclaimer, the term of this patent is extended or adjusted under 35 U.S.C. 154(b) by 143 days.

(21) Appl. No.: 18/097,016

(22) Filed: Jan. 13, 2023

(65) Prior Publication Data

US 2024/0237825 A1 Jul. 18, 2024

(51) Int. Cl.
*A47C 7/00* (2006.01)
*A47C 7/14* (2006.01)

(52) U.S. Cl.
CPC ..... *A47C 7/008* (2013.01); *A47C 7/14* (2013.01)

(58) Field of Classification Search
CPC . E04C 5/168; E04C 5/20; E04C 5/167; E04C 5/162
USPC ..... 52/685, 684
See application file for complete search history.

(56) References Cited

U.S. PATENT DOCUMENTS 3,471,987 A 10/1969 Yelsma
3,694,989 A 10/1972 Oliver et al.
3,830,032 A * 8/1974 Robb ..... E04C 5/206 52/687
4,060,954 A * 12/1977 Liuzza ..... E04C 5/168 52/309.1
4,598,523 A * 7/1986 Tolliver ..... E04C 5/168 52/685
4,835,933 A * 6/1989 Yung ..... E04C 5/168 52/685
5,400,562 A * 3/1995 Bahr ..... E04C 5/201 52/678
6,089,522 A * 7/2000 Haslem ..... E04C 5/206 404/136
6,279,274 B1 * 8/2001 Amiet ..... E04C 5/20 52/125.4
6,282,860 B1 * 9/2001 Ramirez ..... E04C 5/203 52/686

(Continued)

FOREIGN PATENT DOCUMENTS

CN 2744763 12/2005
EP 794296 9/1997

(Continued)

OTHER PUBLICATIONS

"For 3/4" rebar" Retrieved from https://www.surv-kap.com/index.php?route=product/product&product_id=209&gclid=EAIaIQobChMI-rOVOc7O-gIVXwatBh0-dQ9UEAQYBCABEgJsb_D_BwE, 4 pages.

(Continued)

*Primary Examiner* — Jose V Chen
(74) *Attorney, Agent, or Firm* — Gray Ice Higdon

(57) ABSTRACT

A vertical adjustment mechanism for adjusting the height or elevation of one or more support structures relative to the reference surface. A chair and spacer may be used to adjust the elevation of the one or more support structures. The spacer may include one or more retention clips and/or receptacles.

23 Claims, 9 Drawing Sheets

(56) References Cited

U.S. PATENT DOCUMENTS

| | | | | |
|---|---|---|---|---|
| 6,663,316 | B1 * | 12/2003 | Harris | E04C 5/167 404/136 |
| 7,322,158 | B1 | 1/2008 | Sorkin | |
| 7,798,920 | B1 * | 9/2010 | Cortes | A63B 67/00 482/14 |
| 7,810,298 | B1 * | 10/2010 | Sorkin | E04C 5/168 404/136 |
| 7,950,190 | B2 * | 5/2011 | Schulze | E04G 15/04 52/125.4 |
| 8,869,489 | B2 * | 10/2014 | Findlay | E04F 15/14 52/684 |
| 9,115,492 | B2 * | 8/2015 | Parham | E04C 5/168 |
| 10,041,252 | B1 | 8/2018 | Bongiorno | |
| 10,472,826 | B2 | 11/2019 | Ki et al. | |
| 11,242,683 | B2 | 2/2022 | Park | |
| 11,332,935 | B2 | 5/2022 | Allington et al. | |
| 11,572,694 | B2 * | 2/2023 | Ball | E04D 13/00 |
| 11,634,909 | B2 * | 4/2023 | Cramer | E04C 5/206 52/684 |
| 2004/0055234 | A1 | 3/2004 | Mutsuyoshi | |
| 2004/0206030 | A1 * | 10/2004 | Juedes | E04C 5/168 52/384 |
| 2006/0053735 | A1 | 3/2006 | Kim | |
| 2008/0202052 | A1 * | 8/2008 | Meier | E04F 21/05 52/367 |
| 2011/0214381 | A1 * | 9/2011 | Alfonso | E04C 5/168 52/685 |
| 2012/0233956 | A1 | 9/2012 | Fey | |
| 2015/0211232 | A1 | 7/2015 | Baruh | |

FOREIGN PATENT DOCUMENTS

| | | |
|---|---|---|
| KR | 20140065558 | 5/2014 |
| WO | 9001600 | 2/1990 |
| WO | WO-9001600 A1 * | 2/1990 |

OTHER PUBLICATIONS

International Search Report and Written Opinion issued for Application No. PCT/US2024/011395, 13 pages, dated Apr. 18, 2024.

* cited by examiner

APPARATUS AND METHOD OF VERTICALLY ADJUSTING REINFORCING SUPPORT STRUCTURE

BACKGROUND

The present embodiments relate to spacing and supporting chairs, with particular embodiments shown for reinforcing support structure used to reinforce material.

A typical chair positions, spaces, and supports support structure from a reference/ground/surface in at least one fixed elevation. This may lead to problems including, but is not limited to, the inability to position the support structure at another elevation using the chair. Thus, there is a need to vertically adjust the elevation of the one or more support structures for one or more applications. A need therefore exists in the art for adjusting the elevation of one or more support structures.

Embodiments herein disclose a chair design that allows users to adjust the vertical elevation of one or more support structures.

SUMMARY

In some embodiments, an apparatus for adjusting the elevation of one or more support structures for material may include a chair having an upper end and a lower end. In various embodiments, the upper end includes a receptacle configured to support at least one support structure. In some embodiments, the apparatus may include one or more vertical adjustment mechanisms configured to engage the receptacle of the chair to space at least one support structure vertically away from the receptacle of the chair to vary the elevation of at least one support structure relative to the lower end of the chair.

In addition, in some embodiments, the one or more vertical adjustment mechanisms may be positionable between an engaged configuration between the receptacle of the chair and at least one support structure and a disengaged configuration no longer between the receptacle of the chair and at least one support structure, and wherein at least one support structure is positioned at a higher elevation when in the engaged configuration than when in the disengaged configuration. In various embodiments, the one or more vertical adjustment mechanisms may be a single member vertically abutting the receptacle of the chair. In some embodiments, the one or more vertical adjustment mechanisms may include one or more retention clips engaging at least one of at least one support structure and/or the upper end of the chair. In various embodiments, the one or more retention clips may be resilient. In some embodiments, the one or more vertical adjustment mechanisms may include a receptacle configured to engage at least one support structure. In various embodiments, the one or more vertical adjustment mechanisms may rotate about at least one support structure. In some embodiments, the one or more vertical adjustment mechanisms may engage one or more portions of the receptacle of the chair. In various embodiments, the one or more vertical adjustment mechanisms may engage two portions of the one or more portions of the receptacle of the chair at the same elevation and spaced away from each other. In some embodiments, the one or more vertical adjustment mechanisms may engage a single portion of the one or more portions of the receptacle of the chair.

In some embodiments, an apparatus for adjusting the elevation of one or more support structures for material may include a chair having an upper end and a lower end. In various embodiments, the upper end may include one or more receptacles configured to support one or more support structures. In some embodiments, the apparatus may include one or more spacers having an upper end and a lower end, wherein the upper end of the one or more spacers includes a receptacle configured to engage one or more support structures and the lower end of the one or more spacers are configured to engage the receptacle of the chair to space the one or more support structures in the receptacle of the one or more spacers vertically away from the upper end of the chair to vary an elevation of the one or more support structures relative to the lower end of the chair.

In addition, in some embodiments, the chair may be different from the spacer. In various embodiments, the chair may position the one or more support structures in at least one first elevation without the spacer engaged thereto and the one or more spacers when engaged to the chair may position the one or more support structures in at least one second elevation higher than at least one first elevation. In some embodiments, the one or more spacers may be positionable in one or more rotational positions relative to the chair when engaged to the receptacle of the chair. In various embodiments, the one or more spacers may be positionable in one or more rotational positions relative to the one or more support structures. In some embodiments, the one or more spacers may include an elongated body configured to receive the one or more support structures in the receptacle. In various embodiments, the elongated body may include an outer periphery wherein the outer periphery is arcuate in shape, and wherein the lower end of the spacer includes the outer periphery engaging the receptacle of the chair. In various embodiments, the elongated body may include one or more retention clips. In some embodiments, the spacer may include one or more members.

In some embodiments, a method of vertically adjusting the elevation of one or more support structures for material may include providing one or more support structures. In various embodiments, the method may include providing one or more chairs configured to position the one or more support structures in at least one first elevation. In some embodiments, the method may include engaging one or more spacers to the one or more chairs to position the one or more support structures in at least one second elevation that is higher in elevation than at least one first elevation. In various embodiments, the method may include engaging one or more support structures to the one or more spacers.

In addition, in some embodiments, the one or more chairs may include a receptacle configured to position the one or more support structures in at least one first elevation. In various embodiments, the method may include rotating the one or more spacers relative to the one or more support structures and/or the receptacle of the one or more chairs. In some embodiments, at least one second elevation may be at least a ¼ inch higher than at least one first elevation. In various embodiments, the method may include engaging the one or more spacers to a receptacle of the one or more chairs. In some embodiments, the method may include positioning the one or more spacers between the one or more support structures and the receptacle of the one or more chairs. In various embodiments, the one or more spacers may include a body having a receptacle and an opposing outer periphery, wherein the receptacle of the spacer body positions the one or more support structures in at least one second elevation and the outer periphery engages a receptacle in an upper end of the one or more chairs. In some embodiments, the method may include pouring concrete about the one or more support structures, the one or more chairs, and/or the one or more spacers.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

DETAILED DESCRIPTION

Figure 1:
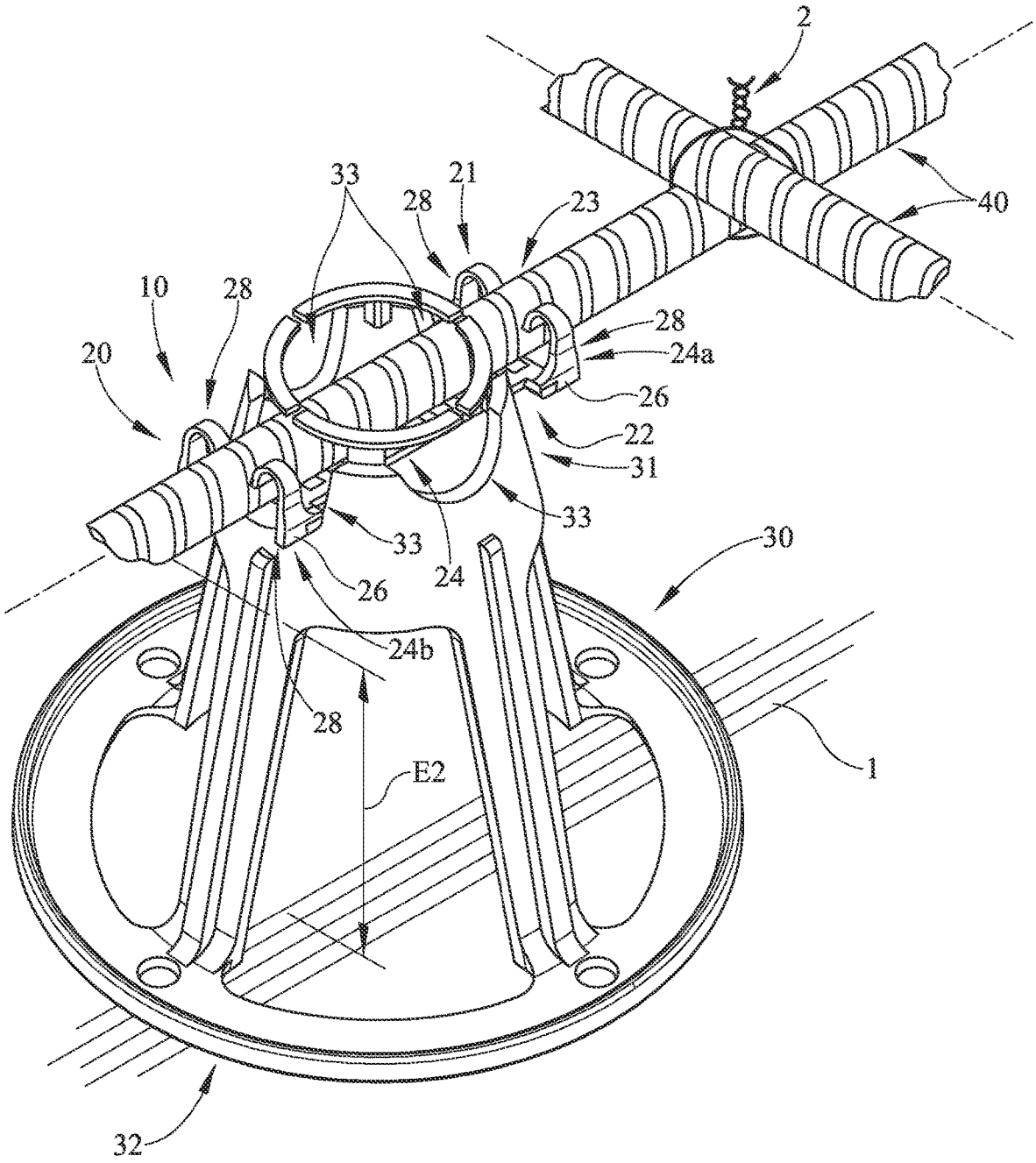
FIG. 1 is a perspective view of an embodiment of a chair and a spacer supporting a support structure, and illustrating the support structure at a second elevation higher than a first elevation available with only the chair.
Figure 2:
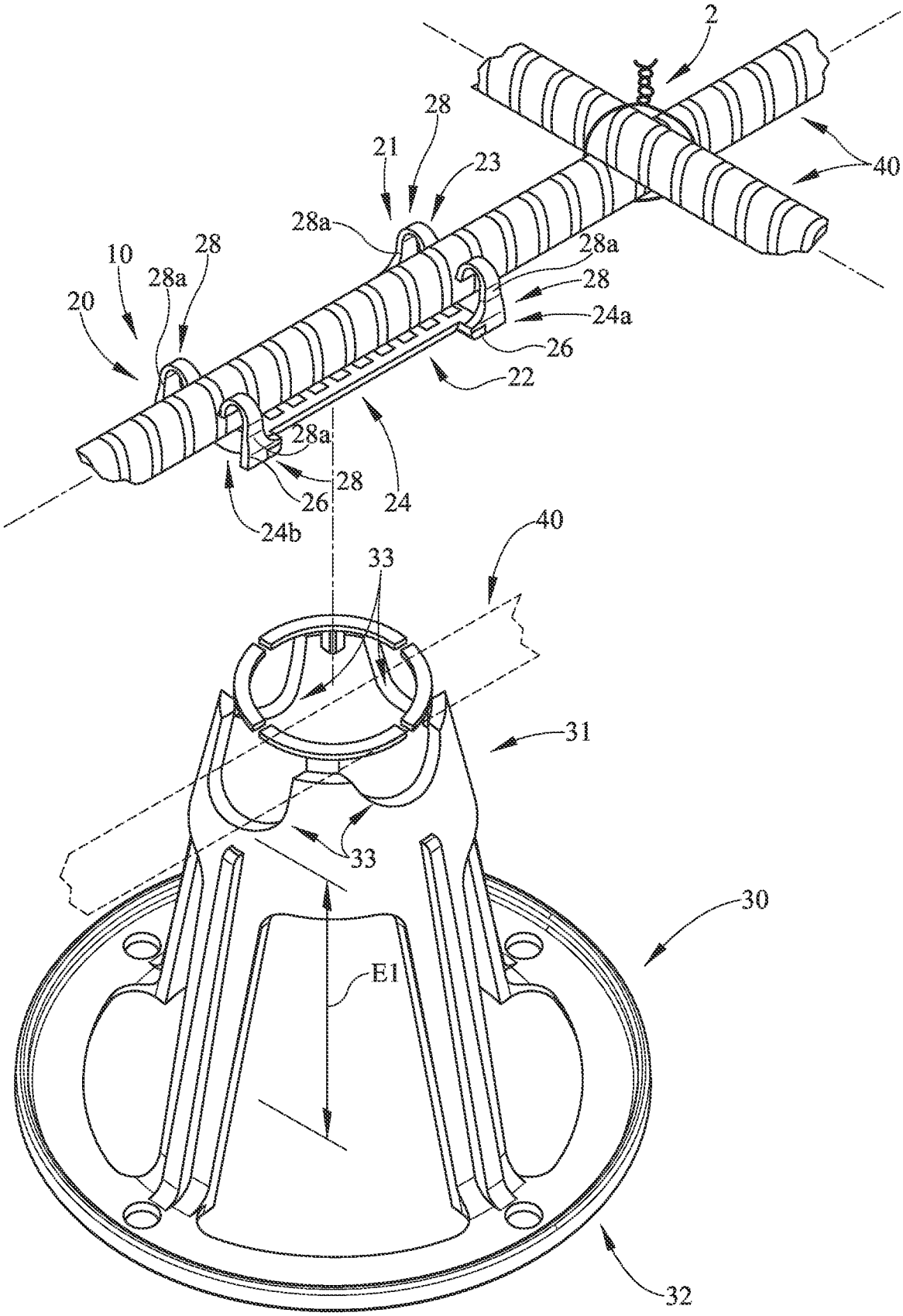
FIG. 2 is a perspective view of the support structure and the spacer of FIG. 1 exploded away from the chair in a disengaged position, and illustrating in broken lines the support structure supported by the chair at the first elevation.
Figure 3:
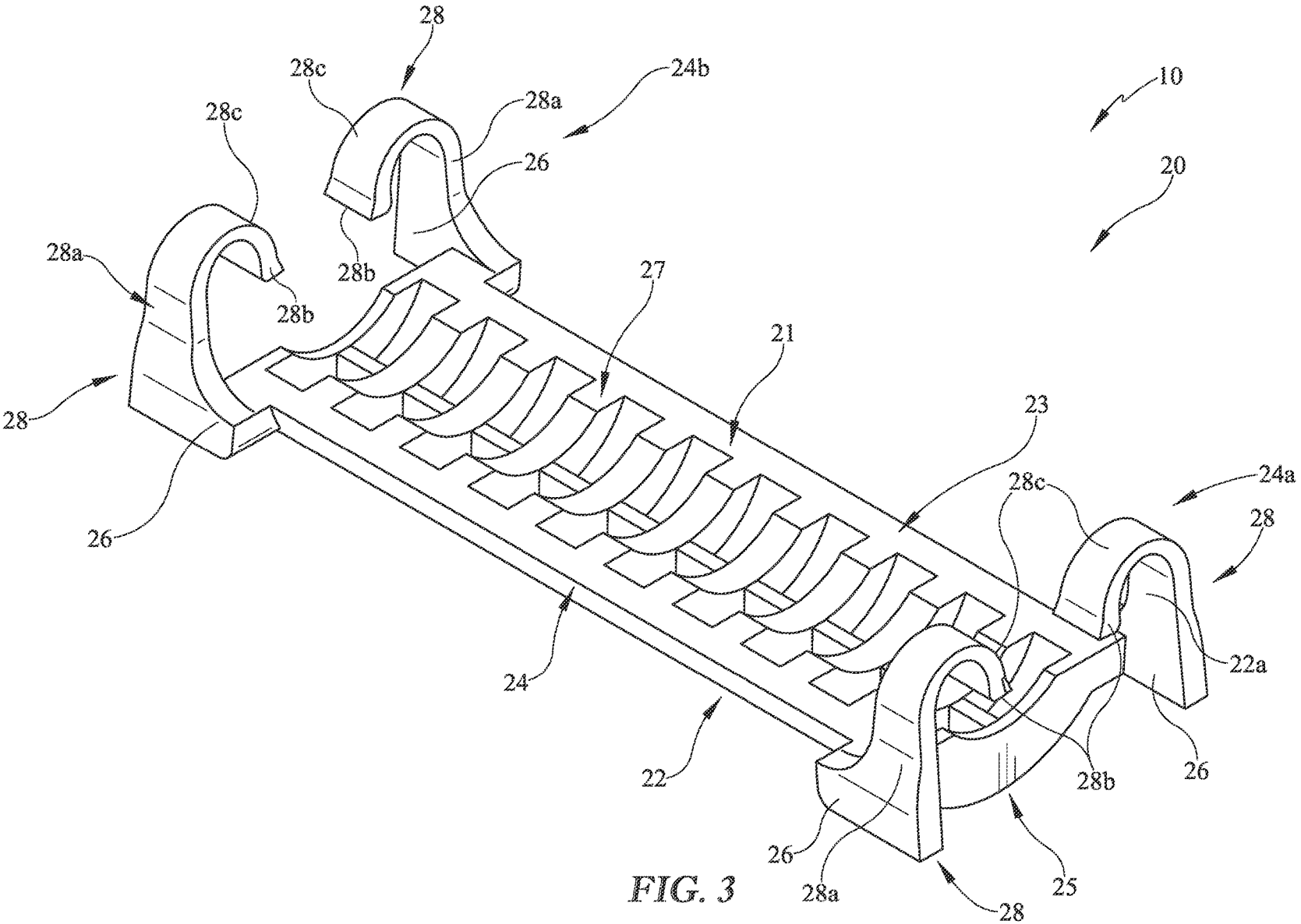
FIG. 3 is a top perspective view of the spacer of FIG. 1.
Figure 4:
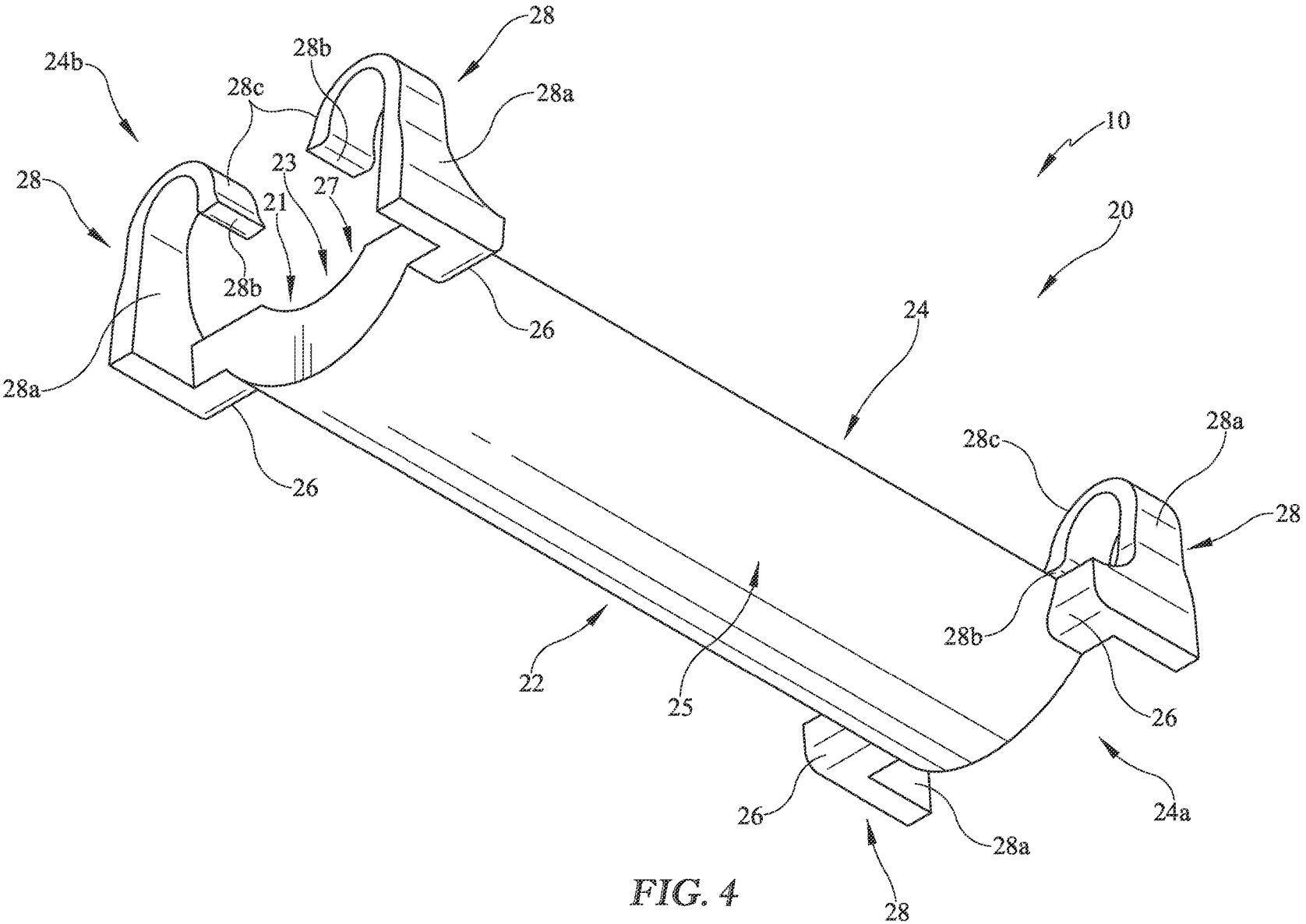
FIG. 4 is a bottom perspective view of the spacer of FIG. 1.

It is to be understood that a chair, a spacer, and/or a support structure is not limited in its application to the details of construction and the arrangement of components set forth in the following description or illustrated in the exemplary drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings.

Turning now to the drawings and in particular FIGS. 1-9, wherein like numbers denote like parts throughout the several views, the apparatus and method may allow the user to select/adjust the desired elevation of one or more support structures 40 for an application (e.g. concrete). The apparatus may include one or more vertical adjustment mechanisms 10 (e.g. spacer 20, 120, 220, 320) configured to engage a chair (e.g. chair 30, 130) to space one or more support structures 40 vertically (e.g. upwardly, downwardly) away from the surface 1 and/or chair 30 (e.g. upper end, lower end) to vary/adjust the overall elevation of the one or more support structures 40 relative to the surface or chair, or portions thereof. If used, the adjustment mechanism 10 may increase the elevation of the one or more support structures 40 for an application. If not used, the adjustment mechanism 10 may decrease the elevation of the one or more support structures 40 for an application.

In some implementations, the vertical adjustment mechanism 10 may include one or more spacers (e.g. upper) or supporting devices 20 used, combined, or stacked upon one or more chairs (e.g. lower) 30 to adjust the cover height or elevation of one or more support structures 40 (e.g. rebar, wire mesh) relative to the ground/surface/grade 1 or lower end/base 32 of the chair 30, or portions thereof. For example, in some implementations combining the one or more spacers 20 to the chair 30 may increase the overall elevation to a second elevation E2 of the one or more support structures 40 (e.g. rebar) that may be higher/greater than a first elevation(s) E1 of applications using only the chair 30, when the spacer 20 is not used. If only the chair 30 is used in an application or the spacer 20, or portions thereof, is removed or moved out of position between the chair 30 and support structure 40, the elevation of one or more support structures 40 may be lowered/reduced or be at the first elevation E1 lower than the second elevation E2. One or more spacers 20, if used, may be a variety of thicknesses and/or add a variety of vertical increments I of elevation that may be selected for use in an application to increase the first elevation E1 to the second elevation E2 of the one or more support structures 40. For example, a spacer 20 may add a ¼ inch increment I in elevation to the first elevation E1 and/or upper end/receptacle 33 of the chair 30 by combining the spacer 20 to the chair 30. In other embodiments, another spacer and/or increment I may be selected to add ⅜ inch, ½ inch, or ⅛ inch to the first elevation E1 and/or chair receptacle 33 to achieve the second elevation E2. Alternatively, the lack of use of the spacer 20, or portion thereof, may decrease the second elevation E2 to the first elevation E1 of the chair 30. In some implementations, a plurality of the chairs 30 may be used to select/adjust an elevation (e.g. first, E1) of the one or more support structures 40. In other implementations, a plurality of the combined chairs 30 and spacers 20 may be used to select an elevation (e.g. second, E2) of the one or more support structures 40. In some implementations, the one or more support structures 40 may be wired (e.g. wire 2) to each other, the chair, the spacer, and/or the combined chair and spacer. In some implementations, material (e.g. concrete) may be poured about the one or more support structures, the chair, and/or spacer.

Figure 5A:
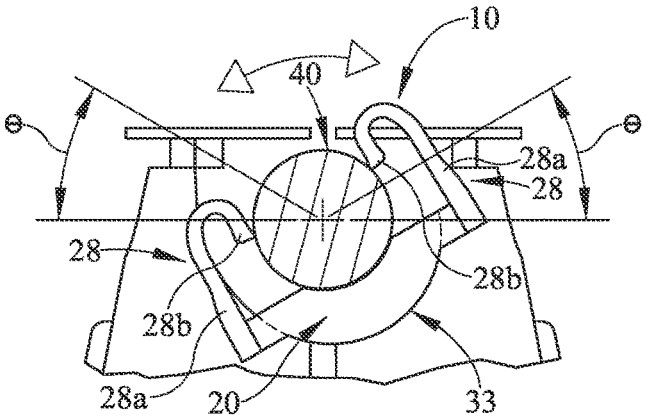
FIG. 5A is a partial side view of the assembled chair and spacer supporting the support structure of FIG. 5 at the second elevation, illustrating the rotational movement/positions of the spacer relative to the chair and/or support structure.
Figure 5:
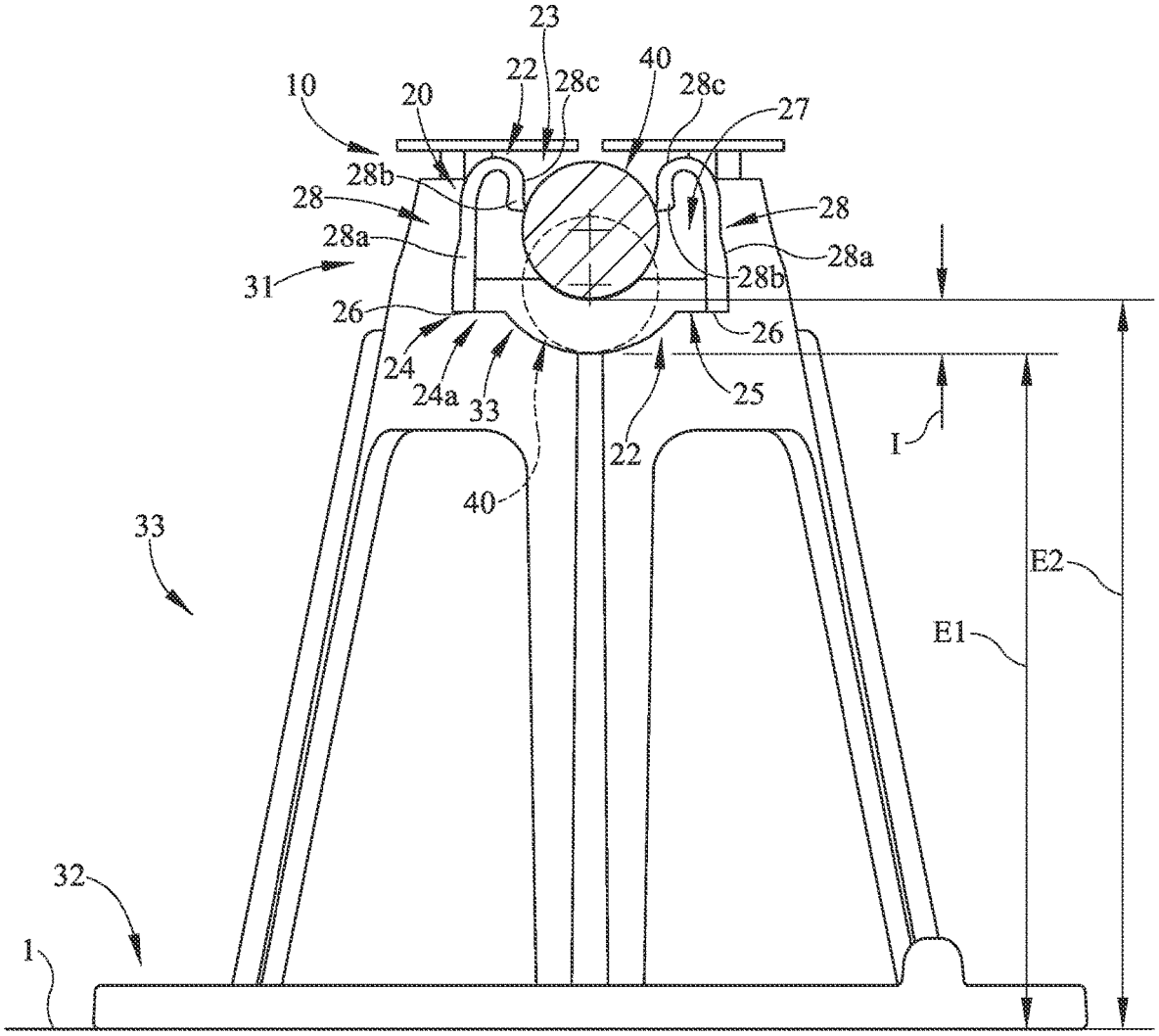
FIG. 5 is a side view of the assembled chair and spacer supporting the support structure of FIG. 1 at the second elevation, and illustrating in broken lines the support structure may be supported by the chair at the first elevation lower than the second elevation.
Figure 6:
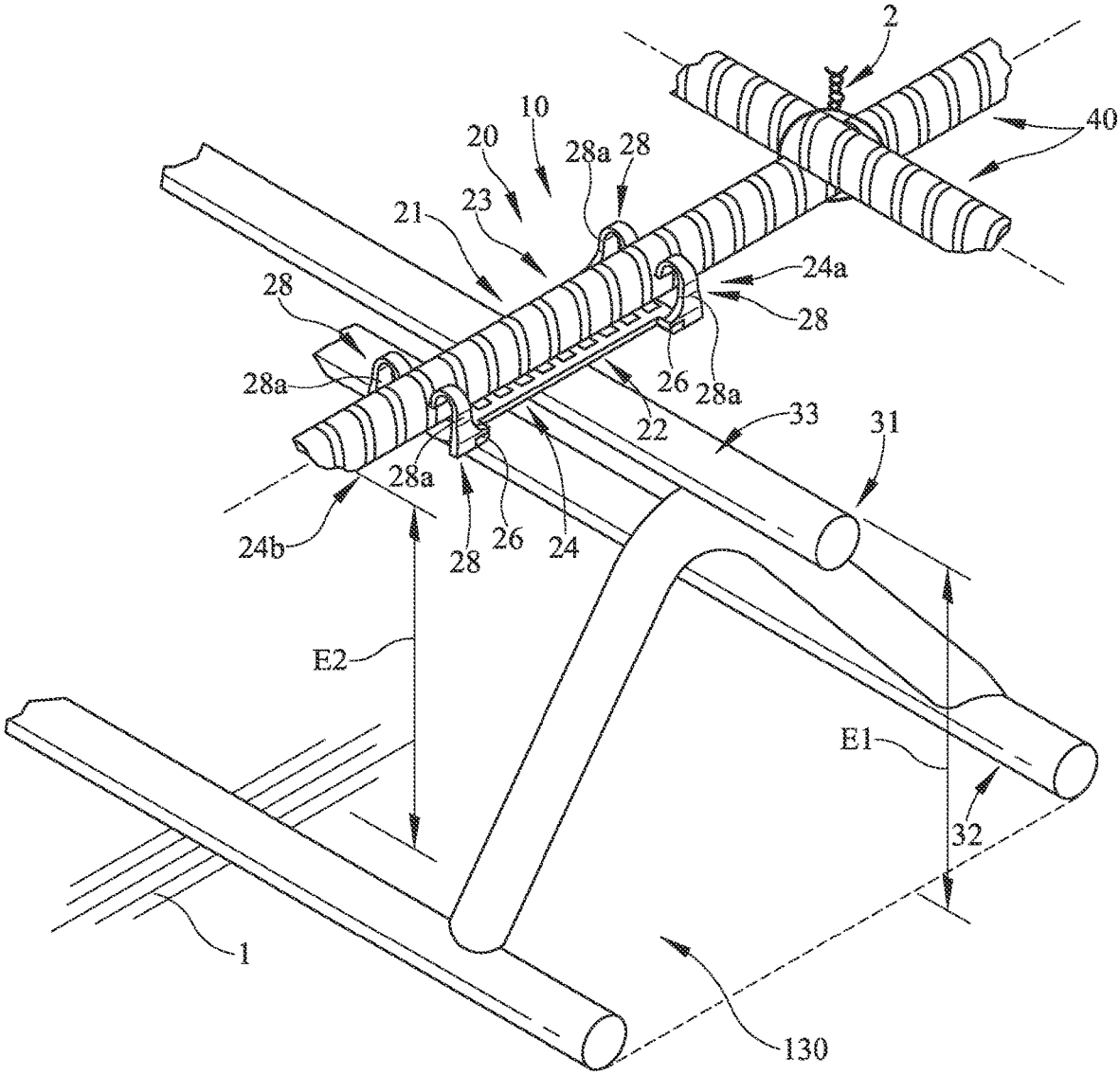
FIG. 6 is a perspective view of the spacer of FIG. 1 with another embodiment of a chair supporting a support structure, and illustrating the support structure at a second elevation higher than a first elevation available with only the chair.
Figure 7:
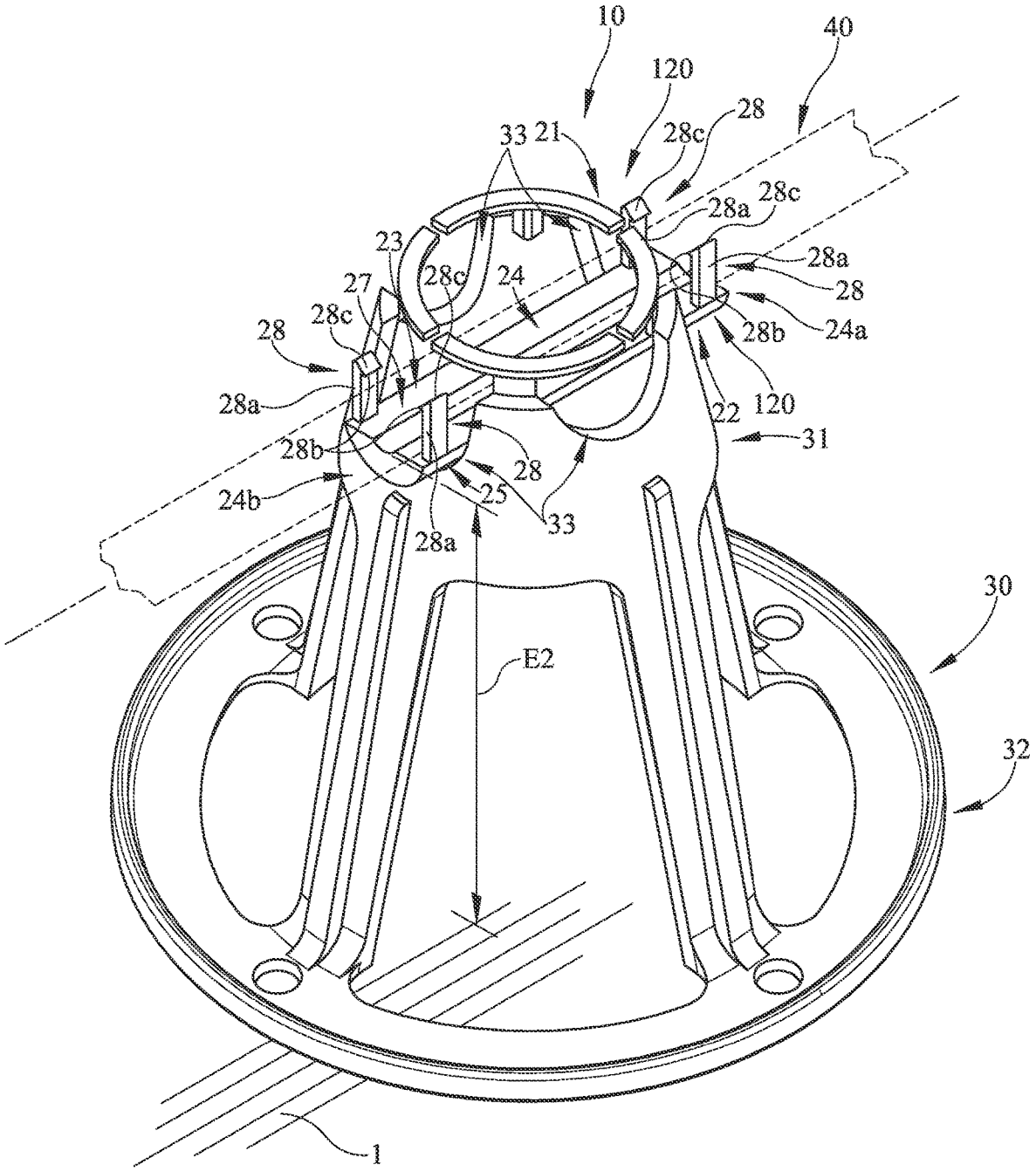
FIG. 7 is a perspective view of the chair of FIG. 1 with another embodiment of a spacer supporting a support structure, and illustrating the support structure in broken lines at a second elevation.
Figure 8:
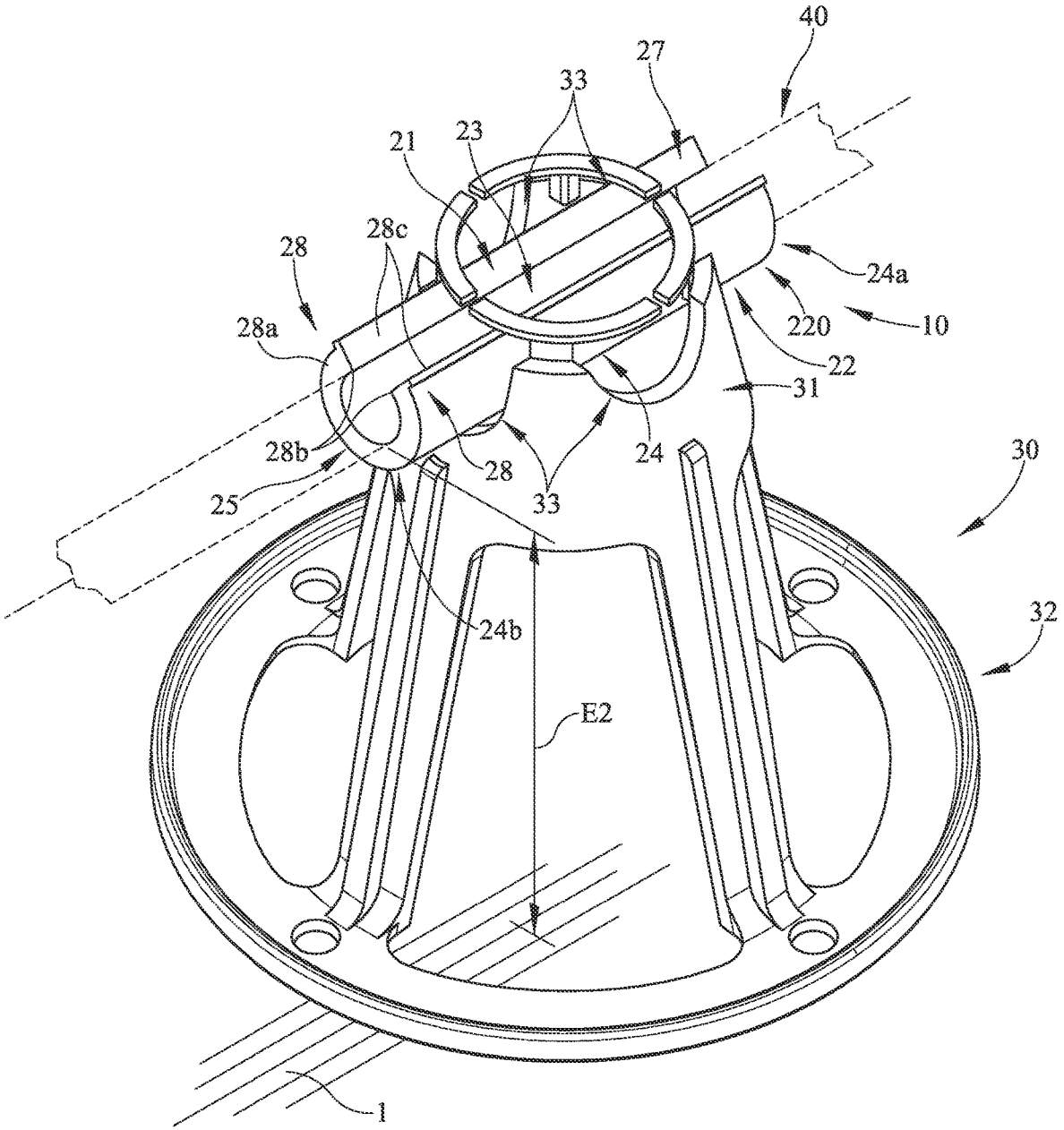
FIG. 8 is a perspective view of the chair of FIG. 1 with another embodiment of a spacer supporting a support structure, and illustrating the support structure in broken lines at a second elevation.

In some implementations, each one of the chair 30 and the spacer 20 may include one or more surfaces, saddles, or receptacles 33, 23 (e.g. U-shaped, planar), respectively. The one or more receptacles 23, 33 may receive, abut, or engage one or more of the support structures 40 and support the structures in spaced relationship from the surface 1, such as but is not limited to the ground. In some embodiments, two or more receptacles may intersect each other to each receive one or more support structures. In other embodiments as shown in FIGS. 1, 2, 5, 5A and 7-9, two or more receptacles 33 within a chair (e.g. 30) may be at different elevations E1 and be used with one or more support structures 40. It should be understood that the one or more spacers 20 may be used with the one or both of the receptacles 33 to adjust the elevation of the one or more support structures 40. In some embodiments as shown in FIG. 6, a chair 130/spacer 20 may only have a single receptacle 23, 33. Each one of the chair 30 and spacer 20 may include an upper end 31, 21 and a lower end 32, 22 lower in elevation than the upper end 31, 21, respectively. As shown in the one embodiment, the upper end 31, 21 or top surface 27 of the chair 30 and spacer 20 may include the one or more receptacles 33, 23, respectively. The receptacle 33, 23 may be a variety of shapes, sizes, quantities, positions, and constructions and still be within the scope of the invention. The spacer 20 may be configured to support the one or more support structures 40 and configured to engage (e.g. stack, supported, abut) the chair 30, or portions thereof (e.g. one or more receptacles 33, upper end 31). In at least one configuration, the spacer 20 engages or is supported on the chair 30 (e.g. receptacle 33, upper end 31) to increase the elevation of the support structure(s) 40 relative to the chair's available first elevation E1. The spacer 20 (e.g. lower end, bottom surface) may engage, be supported upon, or stacked on the upper end 31 and/or receptacle(s) 33 of the chair 30, or portions thereof, to space the support structure(s) 40 vertically away from the surface 1 or chair 30, or portions thereof. When combined in an engaged configuration, the spacer 20 may be positioned between the one or more support structures 40 and the chair 30. The chair 30 or the engaged configuration/combination of the chair 30 and spacer 20 provides support or holds the one or more support structures 40, such as but is not limited to reinforcing bars, pipes, mesh, and the like, spaced from the surface 1 within a form during the pouring and setting of material such as cement, plastic, and the like, surrounding the support structure, chair, and/or chair and spacer. The one or more chairs, one or more spacers, and support structures 40 remain within the material after it is set.

In some implementations, the chair 30 and the spacer 20 may be formed of a variety of suitable material including, but limited to, metals and plastics, and other suitable materials having sufficient strength to support the one or more support structures and/or chair. For example, as shown in FIGS. 1, 2, 5, 5A, and 7-9, the chair 30 and the spacer 20, 120, 220, 230 may be formed of one or more plastics (e.g. same or different material). As shown in FIG. 6, the chair 130 may be a metal material and the spacer 20 may be plastic. The plastic material may be, but is not limited to, a polypropylene, polycarbonate, high density polyethylene, acetal, and/or polymeric carbon ABS plastic, or the like. Moreover, the spacer may be different than the chair. For example, shape, size, quantity, color, and/or construction may be different or the same. Further, in some embodiments, the chair and spacer may be different in color. For example, the chair may be black and the spacer may be orange. With the spacer being a different color than the chair, the user or inspector may be able to identify the use of the spacer in combination with the chair in one or more applications. Further, a plurality of spacers may be different colors to identify different thicknesses for increases in elevation, above the first elevation when the spacer is used with the chair, that may be selected/desired and correspondingly associated with a particular color. For example, one spacer, if used with the chair, may have an increment I or elevation increase of ¼ inch and be orange. Another spacer, if used with the chair, may have an increment I or elevation increase of ⅜ inch and be yellow. Further, the spacer may be of a stronger material than the chair in some embodiments.

In some implementations, the vertical adjustment mechanism 10 or spacer 20 may be positionable relative to the chair, or portions thereof, and/or support structure(s) between at least one first position and at least one second position to vary the elevation (e.g. increase, decrease) of the support structure 40. In the first position or engaged configuration as shown in FIGS. 1, 2, and 5-9, the spacer 20, 120, 220, 320, or portions thereof, may be positioned between the one or more support structures 40 and the chair 30, 130, or portions thereof, to support and/or increase the elevation of the one or more support structures to the second elevation E2. In the second position or disengaged configuration as shown in the one embodiment in FIGS. 2 and 5, the spacer 20, or portions thereof, may be positioned away from the chair 30 or no longer between the one or more support structures 40 and the chair 30 to reduce the elevation and position the support structure 40 at the first elevation E1. The one or more support structures 40 may be positioned at a second elevation E2 when in the engaged position/configuration at a higher elevation than the first elevation E1 when in the disengaged position/configuration.

In some implementations, the one or more spacers 20 may space the one or more support structures 40 vertically relative to (e.g. away from) the chair 30 or surface 1 to vary the elevation of the one or more support structures. As shown in the one embodiment, the spacer 20 supported on the chair 30 increases the elevation of the support structure (s) previously in one or more engagements with the chair alone. The lower end 22 or portions of the one or more spacers 20 may be configured to engage (e.g. supported, stacked, abut, releasably) the upper end 31/receptacle(s) 33, or portions of the chair 30 to space the one or more support structures 40 for an application (e.g. concrete) vertically and/or upwardly away from the chair, or portions thereof, (e.g. upper end) to vary/select the elevation (e.g. E2) of the one or more support structures 40 relative to the lower end 32 or portions of the chair or ground surface 1. The chair(s) 30 may position one or more support structures 40 in at least one first elevation E1 without the use of the spacer 20 engaged thereto. The spacer(s) 20 when engaged or supported on the chair 30 positions the one or more support structures 40 in at least one second elevation E2. At least one second elevation E2 nay be higher than at least one first elevation E1. A plurality of spacers 20 having a variety of thicknesses/increments I may be used to adjust the elevation of the support structure depending on the application and/or selection by the user. The spacer 20 may be different than the chair 30 as shown in the embodiments. As shown in FIG.

5A, the spacer(s) 20 may be positionable in one or more rotational positions at one or more angles θ relative to the chair 30 (e.g. when engaged to the chair) and/or support structures 40.

In some implementations, the spacer 20, 120, 220, 320 and/or vertical adjustment mechanism 10 may include a body 24. The body or spacer may be one or more members (e.g. spaced from each other, connected, single member). The body 24 may be elongated and have opposing ends 24*a* and 24*b* as shown in the embodiments in FIGS. 1-9. The elongated body 24, or portions thereof, may be configured to receive one or more support structures 40. The body may be an open sided segment or channel configured to receive one or more portions of the support structure 40. The body 24 or lower end of the spacer 20 may include an outer periphery or bottom surface 25 that is arcuate in shape and engage one or more receptacles 33 or portions of the chair 30 (e.g. upper end) when engaged thereto. The body 24 may include an inner periphery or top/support surface 27 facing upwardly to engage or support the one or more support structures 40. The inner periphery or top/support surface 27, or portion thereof, may be arcuate or define an elongated, arcuate receptacle to receive a portion of the support structure 40. The spacer, or portions thereof, (e.g. bottom surface) may correspond to and be configured to engage the receptacle(s) 33 of the chair 30 that is configured to engage the support structure 40 if not for use of the spacer. The elongated body 24 of the spacer 20 may rotate relative to the one or more support structures (e.g. longitudinal axis) and/or chair, or portions thereof (e.g. longitudinal axis, receptacle), as shown in FIG. 5A.

Figure 9:
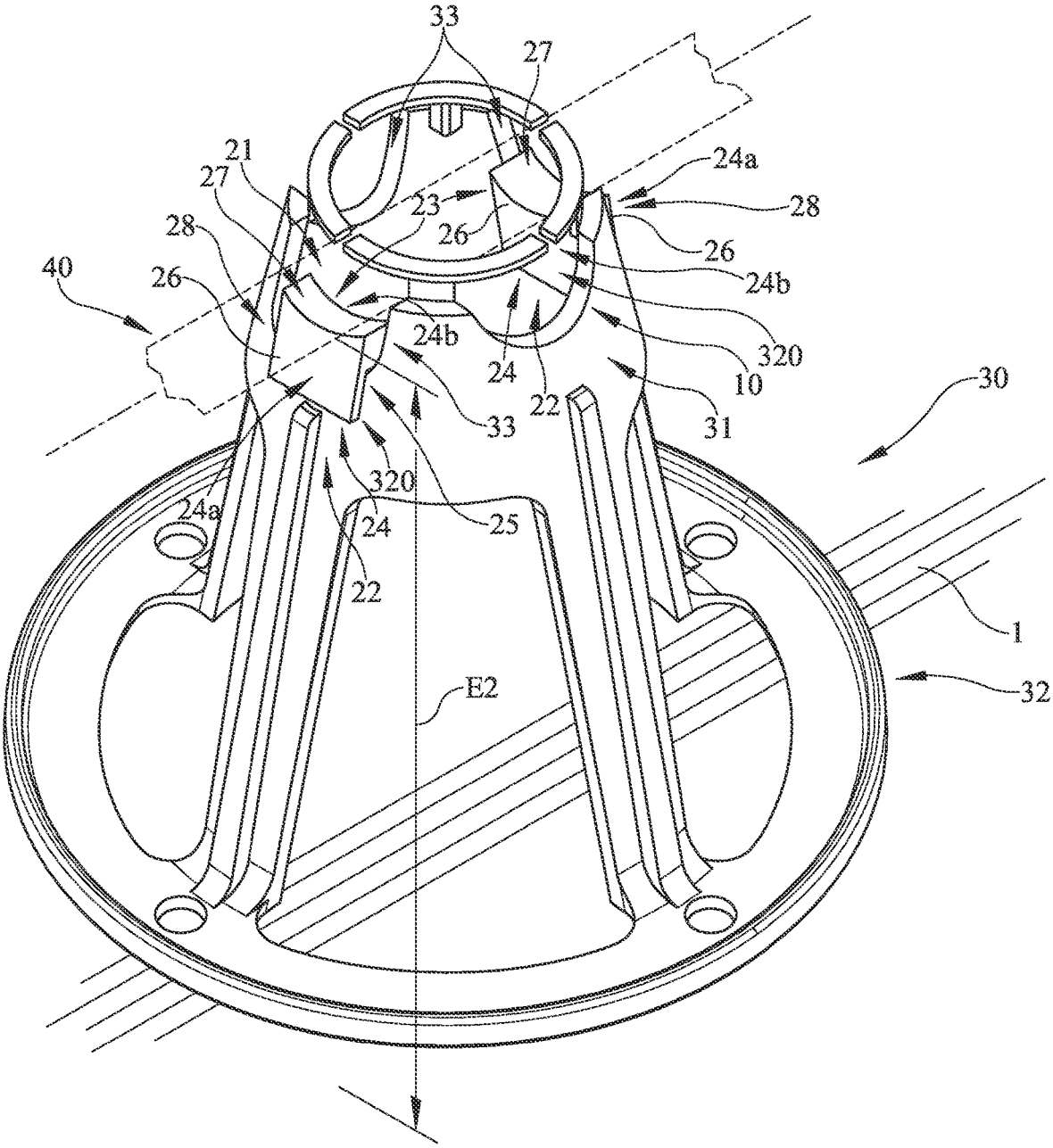
FIG. 9 is a perspective view of the chair of FIG. 1 with another embodiment of a spacer supporting a support structure, and illustrating the support structure in broken lines at a second elevation.

In some implementations, the spacer 20, 120, 220, 320, body 24, and/or vertical adjustment mechanism 10 may include one or more retention clips 28. The one or more retention clips 28, if used, may engage the support structure 40 and/or the chair 30. As shown in FIGS. 1-8, the spacer 20, 120, 220 may include one or more retention clips 28 engaging one or more support structures 40. The one or more retention clips 28 may include one or more arms 28*a* (e.g. resilient) projecting from the body 24, or portions thereof (e.g. top surface, inner periphery, outer periphery, bottom surface). The arms 28*a* may project upwardly from the body 24, or portions thereof. The pair of arms 28*a* may be opposing to each other to define an elongated opening or receptacle 23, or portions thereof, as shown in the figures, or alternatively may be offset from each other along the length of the body and define the elongated opening. The one or more arms 28*a* may include a radially and inwardly extending longitudinal flange(s) 28*b* engageable with the outer periphery of the support structure 40 to aid in holding the structure member within the receptacle 23 and/or allow rotation about the support structure 40 when engaged. The arms 28*a* may also include one or more guides 28*c* with one or more cam surfaces which guide the support structure into the spacer/receptacle 20, 120, 220, 23 and cam the arms of the body outwardly forcing them apart from each other thereby spreading the spacer open to permit entry into the spacer. The clips/arms 28, 28*a* may hold the spacer to the support structure and allow rotation (e.g. about the structure longitudinal axis) of the spacer both clockwise and/or counterclockwise relative to the horizontal plane for an angle θ (e.g. up to a about 60 degrees in each direction) in some embodiments and still be able to support the support structure. Alternatively, the spacer may be rotationally fixed in some embodiments as shown in FIG. 9. As shown in the one embodiment in FIG. 5A, the spacer 20 may rotate about 60 degrees both clockwise and/or counterclockwise from the bottom/horizontal position and still support the support structure 40 and/or be positioned between the support structure 40 and the chair 30. Other angles θ of movement or rotation about the support structure 40 may still be within the scope of the invention. For example, the angle θ from the horizontal may be 0 degrees up to about 50 degrees, up to about 60 degrees, up to about 65 degrees, or up to about 70 degrees in some embodiments. The angle may be less than 30 degrees in some embodiments. The spacer 20 may be attached to or engaged to the support structure 40 before placing together the combined spacer and support structure onto the chair 30, 130 in some applications. In other embodiments, the spacer may be attached/engaged to or supported on the chair (e.g. engage configuration) while the support structure(s) is subsequently attached or engaged to the spacer and/or chair. As shown in FIGS. 1 and 9, the spacer 20, 320 may include one or more retention clips 28 (e.g. arms 26) engaging/supported on the chair 30, or portions thereof. The one or more retention clips 28, if used, may include arms 26 (e.g. resilient, rigid) projecting from the body, or portions thereof (e.g. top surface, inner periphery, outer periphery, ends). The bottom surface 25 and/or ends 24*a, b* may include on or more projections/arms 26 (e.g. outwardly projecting, downwardly projecting, opposing directions) to lateral retain a portion of the chair 30 and reduce travel along the longitudinal axis of the support structure/chair receptacle and/or reduce rotation. The arms 26 may project downwardly/outwardly from the body 24 or outer periphery 25, or portions thereof. The pair of depending arms 26 may be opposite to each other on opposing ends 24*a, b* to define an opening or slot therebetween as shown in the FIG. 9, or alternatively may be offset from each other perpendicular to the body and define the slot. The slot defined by the depending arms 26 may receive one or more portions of the chair 30 (e.g. receptacle, upper end, or outer periphery wall extending between the upper end and bottom of the chair) as shown in FIG. 9. As shown in FIGS. 1-5A, the arms 26 of the spacer 20 on opposing ends 24*a, b* may be outside the outer peripheral extent, the receptacle 33, and/or outer peripheral wall of the chair 30.

In some implementations, the vertical adjustment mechanism 10, chair 30, 130, and/or spacer 20, 120, 220, 320 may be a variety of shapes, sizes, quantities, and constructions and still be within the scope of the invention. The spacer 20, 120, 220 may be a single member engaging the chair 30, 130, or portions thereof, and supported/engaged on the support structure as shown in the one embodiment in FIGS. 1-8. Alternatively for example, as shown in the one embodiment in FIG. 9, the spacer 320 may be two or more members engaging the chair 30, or portions thereof (e.g. one or more receptacles), and engaging the support structure 40. As shown in the one embodiment, the two or more members may be at the same elevation and spaced away from each other. The spacer (e.g. single member, plurality of members) may engage or contact one or more portions of the chair, or portions thereof, (e.g. upper end, receptacle(s)). As shown in the one embodiment in FIGS. 1-5, 7, and 8, the single member of the spacer 20, 120, 220 engages two portions of the upper end 31 or receptacle(s) 33 of the chair 30 at the same elevation and spaced away from each other. As shown in the one embodiment in FIG. 9, each member of the spacer 320 engages a portion, respectively, of the upper end 31 or receptacle(s) 33 at the same elevation and spaced away from each other. Further, as shown in the one embodiment in FIG. 6, the member (e.g. single) of the spacer 20 engages a single portion/receptacle/rail (e.g. top) of the chair 130.

In use, the elevation of one or more support structures 40 may be vertically adjusted (e.g. upwardly, downwardly) by one or more spacers 20. One or more chairs 30 may be positioned in one or more patterns or locations on the ground surface 1. Alternatively, the chair(s) 30 may be attached to one or more support structures 40 then placed on the ground surface 1 in some applications. The one or more chairs 30 are configured to position one or more support structures 40 in at least one first elevation E1. One or more spacers 20, if used, may be engaged (e.g. supported, abutted, stacked) to the chair 30 and/or support structure(s) 40 to position/support one or more support structures 40 in at least one second elevation E2 that is higher in elevation (e.g. ⅜ inch, ¼ inch, etc.) than at least one first elevation E1 supported by the chair 30. In the engaged configuration, the spacer 20, or portions thereof, may be positioned between the support structure 40 and the chair 30. The spacer(s) 20 may be engaged to (e.g. supported on) the chair(s) 30 in various embodiments, subsequently the support structures 40 may be engaged to the spacer(s) 20. In some embodiments, the one or more spacers 20 may be engaged to the one or more support structures 40 then both the spacer(s) 20 and support structure(s) 40 are engaged to the chair(s) 30. The spacer 20 may include one or more retention clips 28, if used, engaging the chair 30 and/or support structure 40. The one or more spacers 20 may be rotated between one or more angles θ relative to the support structure and/or chair in some embodiments when engaged and/or disengaged from the chair. Support structures 40 may be secured/affixed/wired to another support structure 40, chair 30, spacer 20, and/or combined chair and spacer by one or more wires 2. Material, such as but is not limited to concrete, may be poured about the support structure(s), chair(s), and/or spacer(s).

In some implementations, supporting the support structure 40 with the spacer 20 and the chair 30 may reduce the size or gauge of support structure (e.g. rebar) that would have been supported by only the use of the chair (e.g. receptacle). Use of the spacer 20 may reduce the size of rebar or structure that may be received/supported by combining the receptacles of the chair and spacer and/or placing the spacer in the chair receptacle. For example, a chair that may originally receive up to a #8 rebar (1 inch) when not engaging a spacer may receive up to a #6 rebar (diameter 0.75 inches) when combined with the spacer (e.g. increment/thickness or height of ¼ inch).

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one." in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

The invention claimed is:

1. An apparatus for adjusting the elevation of one or more support structures for material comprising:

a chair having an upper end and a lower end, wherein the upper end includes a receptacle configured to support at least one support structure;

one or more vertical adjustment mechanisms configured to engage the receptacle of the chair to space the at least one support structure vertically away from the receptacle of the chair to vary the elevation of the at least one support structure relative to the lower end of the chair; and wherein the one or more vertical adjustment mechanisms is positionable between an engaged configuration between the receptacle of the chair and the at least one support structure and a disengaged configuration no longer between the receptacle of the chair and the at least one support structure, and wherein when in the engaged configuration the one or more vertical adjustment mechanisms is adapted to position the at least one support structure at a higher elevation than when in the disengaged configuration.

2. The apparatus of claim 1 wherein the one or more vertical adjustment mechanisms is a single member vertically abutting the receptacle of the chair.

3. The apparatus of claim 1 wherein the one or more vertical adjustment mechanisms includes one or more retention clips engaging at least one of the at least one support structure and/or the upper end of the chair.

4. The apparatus of claim 3 wherein the one or more retention clips are resilient.

5. The apparatus of claim 3 wherein the one or more vertical adjustment mechanisms includes a receptacle configured to engage the at least one support structure.

6. The apparatus of claim 1 wherein the one or more vertical adjustment mechanisms rotate about the at least one support structure.

7. The apparatus of claim 1 wherein the one or more vertical adjustment mechanisms engages one or more portions of the receptacle of the chair.

8. The apparatus of claim 7 wherein the one or more vertical adjustment mechanisms engages two portions of the one or more portions of the receptacle of the chair at the same elevation and spaced away from each other.

9. The apparatus of claim 7 wherein the one or more vertical adjustment mechanisms engages a single portion of the one or more portions of the receptacle of the chair.

10. An apparatus for adjusting the elevation of one or more support structures for material comprising:

a chair having an upper end and a lower end, and wherein the upper end includes a receptacle configured to support one or more support structures;

one or more spacers having an upper end and a lower end, wherein the upper end of the one or more spacers includes a receptacle configured to engage one or more support structures and the lower end of the one or more spacers are configured to engage the receptacle of the chair to space the one or more support structures in the receptacle of the one or more spaces vertically away from the upper end of the chair to vary an elevation of the one or more support structures relative to the lower end of the chair; and wherein the chair positions the one or more support structures in at least one first elevation without the spacer engaged thereto and the one or more spacers when engaged to the chair positions the one or more support structures in at least one second elevation higher than the at least one first elevation.

11. The apparatus of claim 10 wherein the chair is different from the spacer.

12. The apparatus of claim 10 wherein the one or more spacers are positionable in one or more rotational positions relative to the chair when engaged to the receptacle of the chair.

13. The apparatus of claim 10 wherein the one or more spacers are positionable in one or more rotational positions relative to the one or more support structures.

14. The apparatus of claim 10 wherein the one or more spacers include an elongated body configured to receive the one or more support structures in the receptacle.

15. The apparatus of claim 14 wherein the elongated body includes an outer periphery wherein the outer periphery is arcuate in shape, and wherein the lower end of the spacer includes the outer periphery engaging the receptacle of the chair.

16. The apparatus of claim 14 wherein the elongated body includes one or more retention clips.

17. The apparatus of claim 10 wherein the spacer includes one or more members.

18. A method of vertically adjusting the elevation of one or more support structures for material comprising:

providing one or more support structures;

providing one or more chairs configured to position the one or more support structures in at least one first elevation;

engaging one or more spacers to the one or more chairs to position the one or more support structures in at least one second elevation that is higher in elevation than the at least one first elevation;

engaging one or more support structures to the one or more spacers; and wherein the one or more chairs includes a receptacle configured to position the one or more support structures in the at least one first elevation, and further comprising rotating the one or more spacers relative to the one or more support structures and/or the receptacle of the one or more chairs.

19. The method of claim 18 wherein the at least one second elevation is at least a ¼ inch higher than the at least one first elevation.

20. The method of claim 18 further comprising engaging the one or more spacers to a receptacle of the one or more chairs.

21. The method of claim 20 further comprising positioning the one or more spacers between the one or more support structures and the receptacle of the one or more chairs.

22. The method of claim 18 wherein the one or more spacers include a body having a receptacle and an opposing outer periphery, wherein the receptacle of the spacer body positions the one or more support structures in the at least one second elevation and the outer periphery engages a receptacle in an upper end of the one or more chairs.

23. The method of claim 18 further comprising pouring concrete about the one or more support structures, the one or more chairs, and/or the one or more spacers.

* * * * *